United States Patent [19]

Witt et al.

[11] 4,107,359

[45] Aug. 15, 1978

[54] METHOD OF DRYING COATED CANS

[75] Inventors: Karl-Heinz Witt, Recklinghausen; Walter Sommer, Essen, both of Fed. Rep. of Germany

[73] Assignee: Fried. KRUPP Gesellschaft mit beschränkter Haftung, Essen, Fed. Rep. of Germany

[21] Appl. No.: 415,364

[22] Filed: Nov. 13, 1973

Related U.S. Application Data

[63] Continuation of Ser. No. 246,420, Apr. 21, 1972, abandoned.

[30] Foreign Application Priority Data

May 28, 1971 [DE] Fed. Rep. of Germany ..... 2126598

[51] Int. Cl.[2] ..... B05D 3/02; B05D 7/22; F26B 3/20

[52] U.S. Cl. ..... 427/388 R; 34/12; 34/21; 34/39; 34/104; 118/59; 118/DIG. 3; 219/521; 219/535; 427/230; 427/236; 427/239; 427/318; 427/372 R; 427/383 C; 427/428

[58] Field of Search ..... 117/94, 97, 119.6, 47 H, 117/12, 111 R; 118/59, DIG. 3; 34/1, 12, 39, 104, 21; 219/521, 535; 427/230, 236, 239, 372 R, 383 C, 428, 318; 432/224

[56] References Cited

U.S. PATENT DOCUMENTS

| | | | |
|---|---|---|---|
| 2,006,059 | 6/1935 | Rudorff | 219/43 |
| 2,169,816 | 8/1939 | Pfeffer | 117/94 X |
| 2,910,992 | 11/1959 | Wilcox | 34/105 X |
| 2,932,718 | 4/1960 | Marsters | 219/43 |
| 2,955,959 | 10/1960 | DuRose | 117/94 X |
| 2,981,631 | 4/1961 | Nagel | 117/21 |
| 3,067,056 | 12/1962 | Remer | 118/59 X |
| 3,092,066 | 6/1963 | Jönsson | 118/59 X |
| 3,094,396 | 6/1963 | Flugge et al. | 34/105 X |
| 3,186,860 | 6/1965 | Jones | 117/97 X |
| 3,302,298 | 2/1967 | Stuchbery | 118/59 X |
| 3,369,922 | 2/1968 | Surchek | 117/47 |
| 3,484,585 | 12/1969 | Morey | 219/535 |
| 3,537,187 | 11/1970 | Cvacho et al. | 34/21 |
| 3,610,878 | 10/1971 | Thomes et al. | 219/222 |
| 3,666,915 | 5/1972 | DeNapoli | 219/222 |

*Primary Examiner*—Ronald H. Smith
*Assistant Examiner*—Stuart D. Frenkel
*Attorney, Agent, or Firm*—Walter Becker

[57] ABSTRACT

A method of drying cans to be covered with a layer of varnish and/or a printed upon layer, according to which the can body is brought into snug body engagement with a heating body along that can surface which is located opposite the can surface to be covered with the layer while the temperature of the heating body is controlled in conformity with the maximum temperature for hardening the layer to be applied to the respective can.

3 Claims, 4 Drawing Figures

METHOD OF DRYING COATED CANS

This is a continuation of application Ser. No. 246,420, filed Apr. 21, 1972, now abandoned.

The present invention relates to a method of and device for drying cans which are to be varnished and/or to be provided with a printed-on picture.

BACKGROUND OF THE INVENTION

When storing filling goods, such as food, beverages, or the like, in cans, there exists the danger that the respective stored goods will, for instance in view of acidic ingredients, attack the metallic container, and inversely it may happen that components of the metallic container are absorbed by the stored goods so that these goods will be spoiled instead of preserved. In order to prevent such reactions, the inside of the cans may be provided with a protective varnish coat as insulating layer between the metallic wall of the container and the respective goods. In order to realize an economical manufacture of such cans, the varnish coat or layer must dry quickly so that the cans can rapidly be conveyed to the next processing station.

For the same reason a quick drying of outside varnish layers and/or paints of printed-on pictures to be applied to the cans is desired.

The varnishing of the inside of cans is presently used to a great extent, especially in connection with the manufacture of cans for beverages. In this connection, the cans are varnished in inside varnishing automats by the spraying method and are then by means of one or more expensive transporting or conveying systems conveyed to a drying furnace.

With so-called three-sectional cans, the bodies of which are made from sheet metal blanks, the outside varnishing and printing is effected already on the sheet metal. To this end, blanks already printed upon in color are used. With so-called two-sectional cans, the bodies of the cans which may be, for instance, deep drawn and stretched, are printed upon by rollers on their outer circumference and are then conveyed to drying furnaces.

Commercially customary drying furnaces for this purpose work in conformity with the convection or heat radiation principle and are heated electrically or by gas. The heat radiating surfaces and the heating gases are considerably hotter than the desired end temperature of the cans. In order to assure that the cans are not heated up to a temperature higher than the desired end temperature, it is necessary that the cans pass through the drying furnace in a certain period of time. If this time cannot be maintained, for instance, due to irregularities in the operation of the furnace, the varnish will burn and the respective furnace charge must be discarded as rejects. Inasmuch as the temperature of the cans during the passage of the cans through the furnace increases from room temperature to the desired maximum temperature, which maximum temperature corresponds substantially to the optimum temperature for hardening the varnish, it will be appreciated that during a considerable portion of the passage of the cans through the furnace the temperature of the cans is below the temperature which is the optimum temperature for hardening the varnish. This results in a poor exploitation of the drying installation. Inasmuch as the most favorable duration of the passage of the cans through the furnace can be estimated only approximately, and since the actually most favorable time can only be determined by tests made during the operation of the furnace, the output of the drying installation cannot easily be adapted to the production output of the other machines. The output of the drying installation should, however, at least equal the production output of the preceding machines, and it must not be higher than the production output of the succeeding machines if work stoppages or idling times are to be avoided.

It is, therefore, an object of the present invention to provide a method of and device for drying varnishes and/or printing dyes or paints applied to the inside or outside of the can bodies, which will overcome the above referred to drawbacks and will in particular assure that the varnished and/or printed upon cans will not be heated beyond a certain maximum temperature which maximum temperature should substantially equal the optimum temperature for hardening the varnish or paint.

It is another object of the present invention to provide a method and device as set forth above according to which the hardening process can be carried out in a very short and economical time so as to assure an optimum exploitation of the installation.

These and other objects and advantages of the invention will appear more clearly from the following specification in connection with the accompanying drawing, in which:

SUMMARY

The method according to the present invention for drying cans which are to be varnished or printed upon is characterized primarily in that the can bodies are brought into contact with a heating body complementary in shape corresponding to the can to be varnished and/or to be printed upon, the temperature of the heating body being adapted to be controlled.

In cases in which, for instance, the inside varnish coat of a round can has to be dried, the heating body, which may already prior to the heating of the can to the required temperature be heated, has the shape of a hollow cylinder open at least at one end. If an outside varnish and/or paint layer or coat is to be dried, the heating body consists of a substantially cylindrical mandrel which engages the inner surface of the can during the heating operation.

To prevent the varnish and/or paint or dye from being burned during a long stay in the drying installation, for instance in case of an irregularity in the operation of the installation, the temperature of the contacting heating body, the maximum value of which approximately equals the optimum hardening temperature, is controlled by temperature monitors which in response to the admissible maximum temperature being exceeded, will bring about an interruption or reduction of the heating output.

By the contact between the heating body and the can, the heating of the can is due to the principle of conductive heat transfer. This makes possible a very fast heating up, especially of metal cans, to the temperature which is the best for the hardening of the respective varnish and/or paint. In view of the low heat absorption ability of thin-walled deep drawn and stretched cans, a short heating up period only is necessary. Inasmuch as the optimum temperature is reached very quickly, the time for passing the cans through the drying installation can be greatly reduced. The installation can, therefore, be built rather small and requires little space, especially when the spraying and drying is effected in one machine.

DESCRIPTION OF ILLUSTRATED EMBODIMENT

Figure 2:
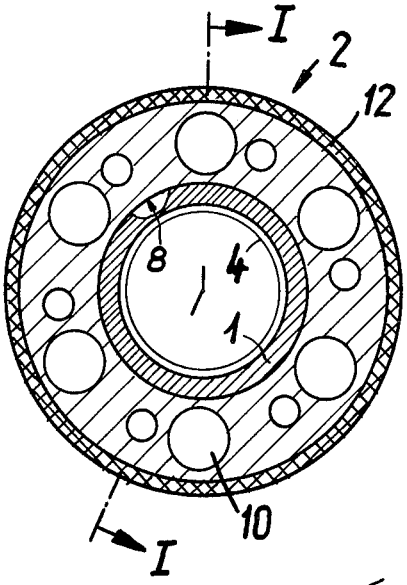
FIG. 2 represents a cross section through the heating pocket of FIG. 1, said section being taken along the line II—II of FIG. 1.
Figure 1:
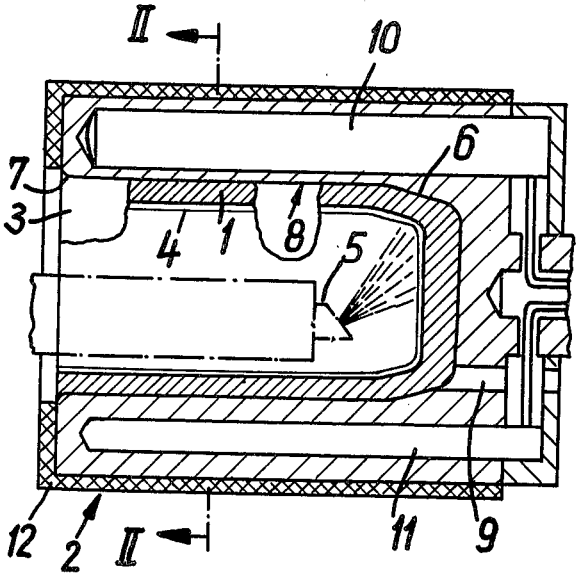
FIG. 1 is a longitudinal section through a heating pocket according to the invention which is suitable for drying the inside coat of cans, said section being taken along the line I—I of FIG. 2.

Referring now to the drawing in detail and FIGS. 1 and 2 thereof in particular, according to the realization of the method of the invention in conformity with these figures, a can 1 is inserted into the hollow chamber of the heating body 2 which hollow chamber is complementary to the outer shape of the can. A slightly conical end 6 of can 1 and a rounded edge 7 at the entrance into the hollow chamber 3 are advantageous. Passages 9 permit the escape of air while the can is being pressed in and inversely permit the entrance of compressed air into the hollow chamber 3 for the ejection of the can.

The application of the varnish coat or layer 4 may be effected with any desired means, for instance, with a spray gun 5. The application may be effected prior to, during or after the can 1 has been inserted into the hollow chamber 3 of the heating body.

The heating of can 1 is effected from the heat radiating contacting surface 8. The heat flow passes through the metal wall of the can and heats the varnish layer 4 from the metal side. As a result thereof, the solvent particles of the varnish are driven from the inside toward the outside. Thus, no varnish skin will form on the outside which would contain the solvent particles as may be the case when the varnish is dried from that side which faces away from the metal wall.

The heating energy is preferably furnished by electric heating cartridges 10. Temperature monitors 11 are arranged in the direct vicinity of the heating cartridges 10 and control the temperature of the heating body. When the admissible temperature of the heating body is exceeded, the current to the heating cartridges 10 is interrupted or reduced by the temperature monitors 11 through the intervention of a non-illustrated control device. If the temperature drops to a lower admissible value, the heating current for heating the heating cartridges is again turned on. In order to assure that the heating output of the heating cartridges 10 be concentrated to the can surface, expediently an insulating layer 12 may be provided.

Figure 4:
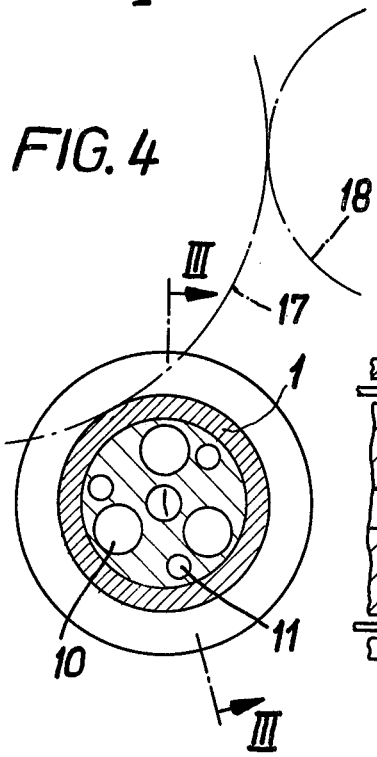
FIG. 4 is a cross section through the heating mandrel of FIG. 3, said section being taken along the line IV—IV of FIG. 3.
Figure 3:
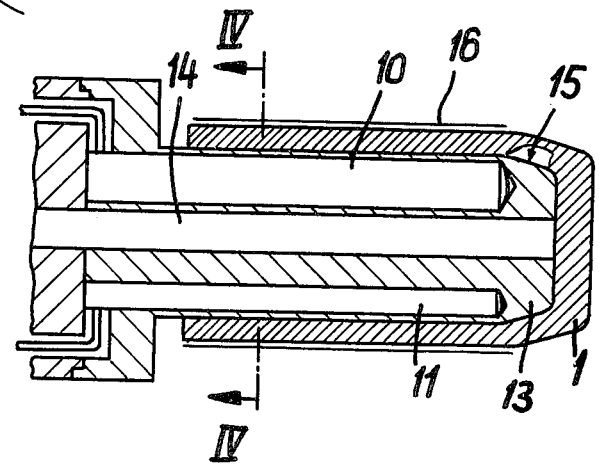
FIG. 3 is a longitudinal section through a heating mandrel according to the invention for drying the coat of varnish and/or paint on the outside surface of a can, said section being taken along the line III—III of FIG. 4.

According to the embodiment of FIGS. 3 and 4, for purposes of drying an outer layer of varnish or paint, a container or hollow body 1 is placed upon a mandrel 13. The air in the can can escape through one or more passages 14. Inversely, compressed air can pass through the passages 14 for ejecting the can from the mandrel. A truncated cone-shaped chamfer 15 at the end of the mandrel 13 permit an easy placing of the can upon the mandrel.

The heating up is effected by heating cartridges 10 which are controlled in an analogous manner by the temperature monitors 11. The application of the varnish and/or paint coat may be effected with any standard means, for instance, by spraying or rolling. According to the embodiment of FIG. 4, a paint layer or coat 16 is applied, for instance, by rolling, for instance, by means of roller bodies 17, 18.

As will be seen from the above, installations operating in conformity with the present invention can be built as very compact installations requiring relatively little space. The method according to the invention, therefore, also has the advantage that the hardening time can already prior to the building of the installation be determined experimentally by a test for which purpose only one heating element has to be put into operation.

It is, of course, to be understood that the present invention is, by no means, limited to the particular showing in the drawing but also comprises any modifications within the scope of the appended claims.

What we claim is:

1. The method of coating and drying one surface of a can having inside and outside surfaces, which includes the steps of:

placing the can with one of said surfaces in contact substantially throughout said one surface with a complementary surface of a heating element;

heating said element and can and controlling said heating not to exceed the optimum temperature of said can for drying the coating material;

coating the other surface of said can while in contact with said heating element, so that the heat from said heating element is transferred to said can to heat the coating material through the material of said can.

2. The method of coating and drying one surface of a can as claimed in claim 1, in which the other surface is coated with varnish.

3. The method of coating and drying one surface of a can having inside and outside surfaces which includes the steps of:

placing the can with one surface in contact substantially throughout said one surface with a complementary surface of a heating element;

heating said element and can and controlling said heating not to exceed the optimum temperature of said can for drying the coating material;

coating the other surface of said can while heated by said heating element, so that the heat from said heating element is transferred to said can to heat said coating material as it is applied to said can.

* * * * *